US005690787A

United States Patent [19]

Hultman et al.

[11] Patent Number: 5,690,787

[45] Date of Patent: Nov. 25, 1997

[54] POLYMER REINFORCED PAPER HAVING IMPROVED CROSS-DIRECTION TEAR

[75] Inventors: David Paul Hultman, Munising; Donald David Watson, Christmas; Edward Walter Heribacka, Munising, all of Mich.

[73] Assignee: Kimberly-Clark Worldwide, Inc., Neenah, Wis.

[21] Appl. No.: 622,498

[22] Filed: Mar. 25, 1996

Related U.S. Application Data

[63] Continuation of Ser. No. 167,746, Dec. 16, 1993, abandoned.

[51] Int. Cl.[6] ..... D21H 19/60

[52] U.S. Cl. ..... 162/112; 162/135; 162/158; 162/164.1; 162/168.1; 162/169; 156/183; 264/282; 264/283; 427/271; 427/276; 427/277; 427/288; 427/356; 427/391; 427/395

[58] Field of Search ..... 162/112, 135, 162/158, 168.1, 169, 164.1; 427/391, 395, 271, 276, 277, 288, 356; 156/183; 264/282, 283

[56] References Cited

U.S. PATENT DOCUMENTS

| | | | |
|---|---|---|---|
| 1,913,017 | 6/1933 | Arpin . | |
| 2,249,118 | 7/1941 | De Witt | 162/158 |
| 2,785,995 | 3/1957 | Kress | 117/118 |
| 3,019,134 | 1/1962 | Hechtman et al. | 162/135 |
| 3,499,823 | 3/1970 | Croon et al. | 162/158 |
| 3,674,632 | 7/1972 | Wennergren | 162/168 |
| 4,303,471 | 12/1981 | Laursen | 162/158 |
| 4,341,597 | 7/1982 | Andersson et al. | 162/135 |
| 4,455,350 | 6/1984 | Berbeco | 428/322.2 |
| 4,481,076 | 11/1984 | Herrick | 162/158 |
| 4,481,077 | 11/1984 | Herrick | 162/158 |
| 4,536,432 | 8/1985 | Holtman | 428/171 |
| 4,590,955 | 5/1986 | Dixit | 131/365 |
| 4,710,422 | 12/1987 | Fredenucci | 428/240 |
| 4,833,011 | 5/1989 | Horimoto | 428/288 |
| 4,849,131 | 7/1989 | Sweeney | 252/312 |
| 4,853,086 | 8/1989 | Graef | 162/157 |
| 5,160,484 | 11/1992 | Nikoloff | 427/439 |
| 5,223,093 | 6/1993 | Klowak | 162/109 |
| 5,223,095 | 6/1993 | Kinsley, Jr. | 162/146 |

FOREIGN PATENT DOCUMENTS

| | | | |
|---|---|---|---|
| 55644 | 12/1970 | Australia | 162/112 |
| 1 195 562 | 10/1985 | Canada | D21H 3/36 |
| 0 213 596 | 3/1987 | European Pat. Off. | D21H 5/00 |
| 93 21382 | 10/1993 | WIPO | D21H 17/06 |

OTHER PUBLICATIONS

Database WPI, Section Ch, Derwent Publications Ltd., London, GB; Class A25, AN 70–1626OR & JP–B–45 005 722 (Seitetsu Kagaku Co. Ltd.) See abstract.

K. W. Britt, "Handbook of Pulp and Paper Tech.," 2nd Ed, Van Nostrand Rheinhold Co., 1970, pp.548–549, pp.666–667, pp.672–674.

"TAPPI", Internal Tearing Resistance of Paper (Elmendorf–type method), pp. 1–6.

*Primary Examiner*—Peter Chin

*Attorney, Agent, or Firm*—William E. Maycock

[57] ABSTRACT

A method of forming a polymer-reinforced paper which includes preparing an aqueous suspension of fibers, at least about 50 percent, by dry weight, of which are cellulosic fibers; distributing the suspension on a forming wire; removing water from the distributed suspension to form a paper; and treating the paper thus formed with a polymer-reinforcing medium which contains a bulking agent to give the polymer-reinforced paper. The treatment of the paper is adapted to provide in the polymer-reinforced paper from about 15 to about 70 percent, by weight, of bulking agent, based on the dry weight of the cellulosic fibers in the paper. Alternatively, the bulking agent can be added to a polymer-reinforced paper after it has been formed. In certain embodiments, the bulking agent is a polyhydric alcohol. In other embodiments, the bulking agent is a polyethylene glycol having a molecular weight in the range of from about 100 to about 1,500. The polymer-reinforced paper has improved cross-direction tear when tested with an Elmendorf Tear Tester in accordance with TAPPI Method T414, particularly when the paper has a moisture content no greater than about 5 percent by weight.

17 Claims, 3 Drawing Sheets

POLYMER REINFORCED PAPER HAVING IMPROVED CROSS-DIRECTION TEAR

This application is a continuation of application Ser. No. 08/167,746 entitled "Polymer Reinforced Paper Having Improved Cross-Direction Tear" and filed in the U.S. Patent and Trademark Office on Dec. 16, 1993 now abandoned. The entirety of this application is hereby incorporated by reference.

BACKGROUND OF THE INVENTION

The present invention relates to a polymer-reinforced paper.

The reinforcement of paper by polymer impregnation is a long-established practice. The polymer employed typically is a synthetic material, and the paper can consist solely of cellulosic fibers or of a mixture of cellulosic and noncellulosic fibers. Polymer reinforcement is employed to improve one or more of such properties as dimensional stability, resistance to chemical and environmental degradation, resistance to tearing, embossability, resiliency, conformability, moisture and vapor transmission, and abrasion resistance, among others.

In general, the property or properties which are desired to be improved through the use of a polymer-reinforced paper depend on the application. For example, the resistance of a paper to tearing, e.g., the cross-direction tear as defined hereinafter, is particularly important when the paper is to be used as a base for masking papers and tapes, abrasive papers for machine sanding, and flexible, tear-resistant marking labels, by way of illustration only.

Moreover, a property such as resistance to tearing can be important for a given product under only certain conditions of use. By way of illustration, the cross-direction tear of a creped masking tape typically is directly proportional to the moisture content of the paper. When the tape is used under conditions of high relative humidity, the tape retains or absorbs moisture and the cross-direction tear usually is more than adequate. Under conditions of low relative humidity, however, such as those encountered during the high temperature curing of painted surfaces, the moisture content of the tape is reduced, with a concomitant reduction in cross-direction tear. When the tape is removed from a surface, slivering, or diagonal tearing of the tape, often occurs.

The use of polyhydric alcohols, including polyethylene glycols, is known in the papermaking art. For example, such materials have been applied locally to the cut edges of pulp sheet in order to reduce the formation of defibered knots. Such materials also have been incorporated in pulp sheets to impart improved dimensional and heat stability, softness and flexibility, wet tensile and wet tear strengths, and dimensional control at high humidities. They have been used to stabilize an absorbent batt of non-delignified fibers.

Such materials also have been used in methods of producing fluffed pulp and redispersible microfibrillated cellulose, to reduce the amount or carbon monoxide produced upon the burning of a cigarette paper, and in the preparation of a nonionic emulsifier useful as a sizing agent for paper.

SUMMARY OF THE INVENTION

It therefore is an object of the present invention to provide a method of forming a polymer-reinforced paper.

It also is an object of the present invention to provide a method of forming a polymer-reinforced creped paper.

It is another object of the present invention to provide a polymer-reinforced paper.

It is a further object of the present invention to provide a polymer-reinforced creped paper.

These and other objects will be apparent to one having ordinary skill in the art from a consideration of the specification and claims which follow.

Accordingly, the present invention provides a method of forming a polymer-reinforced paper which includes preparing an aqueous suspension of fibers with at least about 50 percent, by dry weight, of the fibers being cellulosic fibers; distributing the suspension on a forming wire; removing water from the distributed suspension to form a paper; and treating the paper with a polymer-reinforcing medium which contains a bulking agent so that the paper is provided with from about 15 to about 70 percent, by weight, of bulking agent, based on the dry weight of cellulosic fibers in the paper.

The present invention also provides a method of forming a polymer-reinforced creped paper which includes preparing an aqueous suspension of fibers with at least about 50 percent, by dry weight, of the fibers being cellulosic fibers; distributing the suspension on a forming wire; removing water from the distributed suspension to form a paper; creping the paper thus formed; drying the creped paper; treating the dried creped paper with a polymer-reinforcing medium which contains a bulking agent so that the paper is provided with from about 15 to about 70 percent, by weight, of bulking agent, based on the dry weight of the cellulosic fibers in the paper; and drying the treated creped paper.

The present invention further provides a method of forming a polymer-reinforced paper which includes preparing an aqueous suspension of fibers with at least about 50 percent, by dry weight, of the fibers being cellulosic fibers; distributing the suspension on a forming wire; removing water from the distributed suspension to form a paper; treating the paper with a polymer-reinforcing medium to give the polymer-reinforced paper; and coating the polymer-reinforced paper with a bulking agent so that the paper is provided with from about 15 to about 70 percent, by weight, of bulking agent, based on the dry weight of the cellulosic fibers in the paper.

The present invention additionally provides a polymer-reinforced paper which includes fibers, at least about 50 percent of which on a dry weight basis are cellulosic fibers; a reinforcing polymer; and from about 15 to about 70 percent by weight, based on the dry weight of the cellulosic fibers, of a bulking agent.

In certain embodiments, the polymer-reinforced paper is a polymer-reinforced creped paper. In other embodiments, the polymer-reinforced paper is a latex-impregnated paper. In further embodiments, the polymer-reinforced paper is a creped, latex-impregnated paper. In still other embodiments, the bulking agent is a polyhydric alcohol. In yet other embodiments, the bulking agent is a polyethylene glycol having a molecular weight in a range of from about 100 to about 1,500.

The latex-impregnated paper provided by the present invention is particularly adaptable for use as an abrasive paper base; a flexible, tear-resistant marking label base; and, when creped, as a masking tape base.

DETAILED DESCRIPTION OF THE INVENTION

Figure 1:
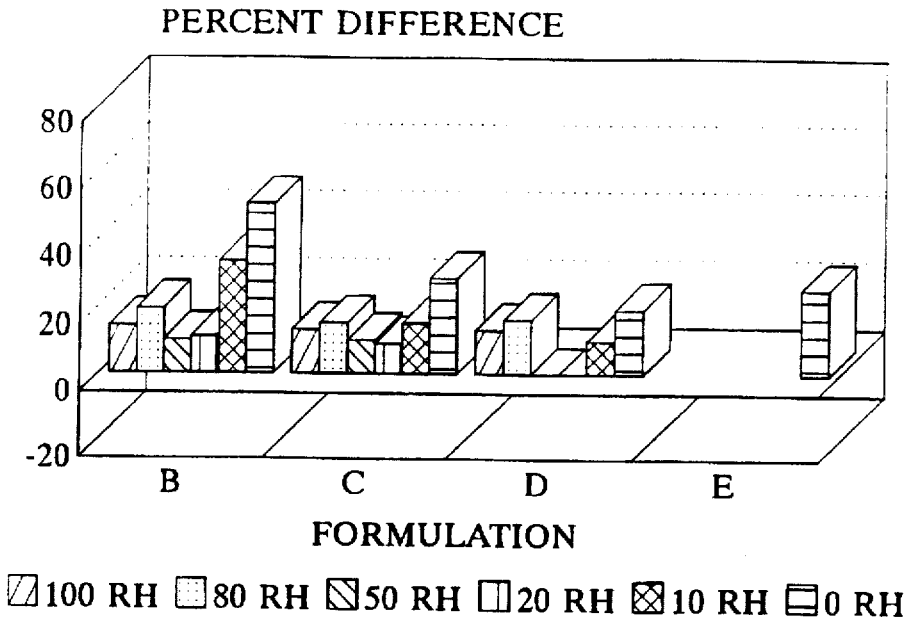
FIGS. 1–5 are three-dimensional bar graphs illustrating the percent differences in the cross-direction tear values at various relative humidities for various polymer-reinforced papers which include a bulking agent, compared with otherwise identical polymer-reinforced papers which lack the bulking agent.

The term "cross-direction" is used herein to mean a direction which is the cross machine direction, i.e., a direction which is perpendicular to the direction of the motion of the paper during its manufacture (the machine direction).

The term "tear" refers to the average result of tear tests as measured with an Elmendorf Tear Tester in accordance with TAPPI Method T414 and under conditions adapted to control the moisture content of the paper being tested. The device determines the average force in grams required to tear paper after the tear has been started. Thus, the term is a measure of the resistance of a paper to tearing. When the paper being tested is oriented in the Tear Tester so that the tearing force being measured is in the cross-direction, the result of the test is "cross-direction tear." For convenience, "cross-direction tear" is reported herein as the average force in grams required to tear four plies or layers of the paper being tested.

A polymer-reinforced paper is prepared in accordance with the present invention by preparing an aqueous suspension of fibers with at least about 50 percent, by dry weight, of the fibers being cellulosic fibers; distributing the suspension on a forming wire; removing water from the distributed suspension to form a paper; and treating the paper with a polymer-reinforcing medium which contains a bulking agent so that the paper is provided with from about 15 to about 70 percent, by weight, of bulking agent, based on the dry weight of cellulosic fibers in the paper. In general, the aqueous suspension is prepared by methods well known to those having ordinary skill in the art. Similarly, methods of distributing the suspension on a forming wire and removing water from the distributed suspension to form a paper also are well known to those having ordinary skill in the art.

The expressions "by dry weight" and "based on the dry weight of the cellulosic fibers" refer to weights of fibers, e.g., cellulosic fibers, or other materials which are essentially free of water in accordance with standard practice in the papermaking art. When used, such expressions mean that weights were calculated as though no water were present.

If desired, the paper formed by removing water from the distributed aqueous suspension can be dried prior to the treatment of the paper with the polymer reinforcing medium. Drying of the paper can be accomplished by any known means. Examples of known drying means include, by way of illustration only, convection ovens, radiant heat, infrared radiation, forced air ovens, and heated rolls or cans. Drying also includes air drying without the addition of heat energy, other than that present in the ambient environment.

Additionally, the paper formed by removing water from the distributed aqueous suspension can be creped by any means known to those having ordinary skill in the art. The paper can be dried and then subjected to a creping process before treating the paper with a polymer-reinforcing medium. Alternatively, the paper can be creped without first being dried. The paper also can be creped after being treated with a polymer-reinforcing medium.

Creping is a wet deforming process which is employed to increase the stretchability of the paper. The process typically involves passing a paper sheet through a water bath which contains a small amount of size. The wet sheet is nipped to remove excess water and then is passed around a heated drying roll that also functions as the creping roll. The size causes the paper sheet to adhere slightly to the creping roll during drying. The paper sheet then is removed from the creping roll by a doctor blade (the creping knife). The amount of stretch and the coarseness of the crepe obtained are controlled by the angle and contour of the doctor blade, the speed of the drying roll, and the sizing conditions. The resulting creped paper then is dried in a completely relaxed condition. Dry creping processes also can be employed, if desired.

In general, the fibers present in the aqueous suspension consist of at least about 50 percent by weight of cellulosic fibers. Thus, noncellulosic fibers such as mineral and synthetic fibers can be included, if desired. Examples of noncellulosic fibers include, by way of illustration only, glass wool and fibers prepared from thermosetting and thermoplastic polymers, as is well known to those having ordinary skill in the art.

In many embodiments, substantially all of the fibers present in the paper will be cellulosic fibers. Sources of cellulosic fibers include, by way of illustration only, woods, such as softwoods and hardwoods; straws and grasses, such as rice, esparto, wheat, rye, and sabai; bamboos; jute; flax; kenaf; cannabis; linen; ramie; abaca; sisal; and cotton and cotton linters. Softwoods and hardwoods are the more commonly used sources of cellulosic fibers. In addition, the cellulosic fibers can be obtained by any of the commonly used pulping processes, such as mechanical, chemimechanical, semichemical, and chemical processes.

In addition to noncellulosic fibers, the aqueous suspension can contain other materials as is well known in the papermaking art. For example, the suspension can contain acids and bases to control pH, such as hydrochloric acid, sulfuric acid, acetic acid, oxalic acid, phosphoric acid, phosphorous acid, sodium hydroxide, potassium hydroxide, ammonium hydroxide or ammonia, sodium carbonate, sodium bicarbonate, sodium dihydrogen phosphate, disodium hydrogen phosphate, and trisodium phosphate; alum; sizing agents, such as rosin and wax; dry strength adhesives, such as natural and chemically modified starches and gums; cellulose derivatives such as carboxymethyl cellulose, methyl cellulose, and hemicellulose; synthetic polymers, such as phenolics, latices, polyamines, and polyacrylamides; wet strength resins, such as urea-formaldehyde resins, melamine-formaldehyde resins, and polyamides; fillers, such as clay, talc, and titanium dioxide; coloring materials, such as dyes and pigments; retention aids; fiber deflocculants; soaps and suffactants; defoamers; drainage aids; optical brighteners; pitch control chemicals; slimicides; and specialty chemicals, such as corrosion inhibitors, flameproofing agents, and anti-tarnish agents.

As used herein, the term "bulking agent" is meant to include any substance which maintains the swelled structure of cellulose in the absence of water. The bulking agent usually will be a polyhydric alcohol, i.e., a polyhydroxyalkane. The more typical polyhydric alcohols, include, by way of illustration only, ethylene glycol, propylene glycol, glycerol or glycerin, propylene glycol or 1,2-propanediol, trimethylene glycol, 1,2-butanediol, 1,3-butanediol, 1,4-butanediol or tetramethylene glycol, 2,3-butanediol, 1,2,4-butanetriol, 1,2,3,4-butanetetrol, 1,5-pentanediol, neopentyl glycol or 2,2-dimethyl-1,3-propanediol, hexylene glycol or 2-methyl-2,4-pentanediol, dipropylene glycol, 1,2,6-hexanetriol, 2-ethyl-1,3-hexanediol, 2,5-dimethyl-2, 5 hexanediol, 1,3-cyclohexanediol, 1,3,5-cyclohexanetriol, 1,4-dioxane-2,3-diol, and 1,3-dioxane-1,3-dimethanol.

In some embodiments, the polyhydric alcohol employed as the bulking agent will be glycerol or a polyalkylene glycol, such as diethylene glycol, triethylene glycol, and the higher molecular weight polyethylene glycols. In other embodiments, the bulking agent will be a polyethylene glycol having a molecular weight in the range of from about 100 to about 1,500. In still other embodiments, the bulking agent will be a polyethylene glycol having a molecular weight in the range of from about 200 to about 1,000. When the paper has a low moisture content, e.g., less than about 3 percent by weight, and the bulking agent is a polyethylene glycol, the polyethylene glycol typically can have a molecular weight in a range of from about 100 to about 1,000.

As used herein with reference to the bulking agent, the term "molecular weight" is intended to mean the actual molecular weight. Because the molecular weight of such materials as polymers often can be measured only as an average molecular weight, the term is intended to encompass any average molecular weight coming within the defined range. Thus, such average molecular weights as number-average, weight-average, z-average, and viscosity-average molecular weight are included in the term "molecular weight." However, it is sufficient if only one of such average molecular weights comes within the defined range.

In general, an amount of bulking agent is employed which is sufficient to improve the cross-direction tear of a polymer-reinforced paper. Such amount typically will be in a range of from about 15 to about 70 percent by weight, based on the dry weight of fiber in the paper. In some embodiments, the amount of bulking agent will be in the range of from about 15 to about 60 percent by weight. In other embodiments, the amount of bulking agent will be in the range of from about 15 to about 35 percent by weight.

In general, any improvement in the average cross-direction tear as measured with an Elmendorf Tear Tester in accordance with TAPPI Method T414 is deemed to come within the scope of the present invention. In certain embodiments, the average cross-direction tear of a polymer-reinforced paper prepared as described herein will be at least about 10 percent higher than the cross-direction tear of an otherwise identical polymer-reinforced paper which lacks the bulking agent. In other embodiments, such average cross-direction tear will be in a range of from about 10 to about 100 percent higher. In still other embodiments, such average cross-direction tear will be in a range of from about 20 to about 100 percent higher. Such cross-direction tear improvements for a polymer-reinforced paper coming within the scope of the present invention may exist only for a given moisture content (i.e., at a certain percent relative humidity) or be observed at any or all levels of moisture content.

As a practical matter, the bulking agent typically will be included in the polymer-containing reinforcing medium, which can be aqueous or nonaqueous. Alternatively, the bulking agent can be added to a polymer-reinforced paper by applying the bulking agent or a solution of the bulking agent to one or both surfaces of the paper by any known means, such as, by way of illustration only, dipping and nipping, brushing, doctor blading, spraying, and direct and offset gravure printing or coating. A solution of bulking agent, when applied to a polymer-reinforced paper, most often will be an aqueous solution. However, other solvents, in addition to or in place of water, can be employed, if desired. Such other solvents include, for example, lower molecular weight alcohols, such as methanol, ethanol, and propanol; lower molecular weight ketones, such as acetone and methyl ethyl ketone; and the like.

Any of the polymers commonly employed for reinforcing paper can be utilized and are well known to those having ordinary skill in the art. Such polymers include, by way of illustration only, polyacrylates, including polymethacrylates, poly(acrylic acid), poly(methacrylic acid), and copolymers of the various acrylate and methacrylate esters and the free acids; styrene-butadiene copolymers; ethylene-vinyl acetate copolymers; nitrile rubbers or acrylonitrile-butadiene copolymers; poly(vinyl chloride); poly(vinyl acetate); ethylene-acrylate copolymers; vinyl acetate-acrylate copolymers;neoprene rubbers or trans-1,4-polychloroprenes; cis -1,4-polyisoprenes; butadiene rubbers or cis- and trans-1,4-polybutadienes; and ethylene-propylene copolymers.

The polymer-containing reinforcing medium in general will be a liquid in which the polymer is either dissolved or dispersed. Such medium can be an aqueous or a nonaqueous medium. Thus, suitable liquids, or solvents, for the polymer-containing reinforcing medium include, by way of illustration only, water; aliphatic hydrocarbons, such as lacquer diluent, mineral spirits, and VM&P naphthas; aromatic hydrocarbons, such as toluene and the xylenes; aliphatic alcohols, such as methanol, ethanol, isopropanol, propanol, butanol, 2-butanol, isobutanol, t-butanol, and 2-ethylhexanol; aliphatic ketones, such as acetone, methyl ethyl ketone, methyl isobutyl ketone, methyl butyl ketone, methyl amyl ketone, 4-methoxy-4-methylpentanone-2,and diacetone alcohol; esters of aliphatic carboxylic acids, such as ethyl acetate, propyl acetate, isopropyl acetate, butyl acetate, isobutyl acetate, and 2-methoxyethyl acetate; glycols, such as ethylene glycol, propylene glycol, and hexylene glycol; glycol ethers and ether esters, such as methoxyethanol, methoxyethoxyethanol, ethoxyethanol, ethoxyethoxyethanol, butoxyethanol, and butoxyethoxyethanol; and cycloaliphatic and heterocyclic compounds, such as cyclohexanone and tetrahydrofuran.

Most often, the polymer-containing reinforcing medium will be a latex, i.e., a dispersion of the reinforcing polymer in water. Consequently, in such embodiments, the polymer-reinforced paper will be a latex-impregnated paper. By way of illustration, a typical latex-impregnated paper is a water leaf sheet of wood pulp fibers or alpha pulp fibers impregnated with a suitable polymer latex. Any of a number of latexes can be used, some examples of which are summarized in Table 1,below.

TABLE 1

Suitable Latexes for Polymer-Reinforced Paper

| Polymer Type | Product Identification |
|---|---|
| Polyacrylates | Hycar ® 26083, 26084, 26120, 26104, 26106, 26322<br>B.F. Goodrich Company<br>Cleveland, Ohio<br>Rhoplex ® HA-8, HA-12, NW-1715, B-15<br>Rohm and Haas Company<br>Philadelphia, Pennsylvania<br>Carboset ® XL-52<br>B.F. Goodrich Company<br>Cleveland, Ohio |
| Styrene-butadiene copolymers | Butofan ® 4264, 4262<br>BASF Corporation<br>Sarnia, Ontario, Canada<br>DL-219, DL-283<br>Dow Chemical Company<br>Midland, Michigan |
| Ethylene-vinyl acetate copolymers | Dur-O-Set ® E-666, E-646, E-669 |

TABLE 1-continued

Suitable Latexes for Polymer-Reinforced Paper

| Polymer Type | Product Identification |
|---|---|
| | National Starch & Chemical Co. Bridgewater, New Jersey |
| Nitrile rubbers | Hycar ® 1572, 1577, 1570X55, 1562X28 B.F. Goodrich Company Cleveland, Ohio |
| Poly(vinyl chloride) | Geon ® 552 B.F. Goodrich Company Cleveland, Ohio |
| Poly(vinyl acetate) | Vinac XX-210 Air Products and Chemicals, Inc. Napierville, Illinois |
| Ethylene-acrylate copolymers | Michem ® Prime 4990 Michelman, Inc. Cincinnati, Ohio |
| | Adcote 56220 Morton Thiokol, Inc. Chicago, Illinois |
| Vinyl acetate-acrylate copolymers | Xlink 2833 National Starch & Chemical Co. Bridgewater, New Jersey |

The impregnating dispersion typically also will contain clay and an opacifier such as titanium dioxide. Typical amounts of these two materials are 16 parts and 4 parts, respectively, per 100 parts of polymer on a dry weight basis. Of course, the impregnating dispersion also can contain other materials, as already described.

The amount of polymer added to the paper, on a dry weight basis, typically will be in the range of from about 10 to about 70 percent, based on the dry weight of the paper. The amount of polymer added, as well as the basis weight of the paper before and after impregnation, in general are determined by the application intended for the polymer-reinforced paper.

Paper-impregnating techniques are well known to those having ordinary skill in the art. Typically, a paper is exposed to an excess of impregnating solution or dispersion, run through a nip, and dried. However, the impregnating solution or dispersion can be applied by other methods, such as brushing, doctor blading, spraying, and direct and offset gravure printing or coating.

The present invention is further described by the examples which follow. Such examples, however, are not to be construed as limiting in any way either the spirit or the scope of the present invention. In the examples, all parts are by weight, unless stated otherwise.

EXAMPLE 1

Because the moisture content of paper under controlled conditions of humidity and temperature is well known, the moisture content of paper samples to be tested was controlled by equilibrating the samples at a predetermined relative humidity at about 23° C. This eliminated the need to actually measure moisture levels. The relationship between relative humidity and moisture content is given in Table 2;moisture content is expressed as percent by weight, based on the weight of the paper.

TABLE 2

Moisture Content of Paper

| % Relative Humidity | Moisture Content |
|---|---|
| 100 | >30 |
| 80 | 15 |
| 50 | 8 |
| 20 | 5 |
| 10 | 3 |
| 0 | 0 |

See, for example, Kenneth W. Britt, Editor, "Handbook of Pulp and Paper Technology," Second Edition, Van Nostrand Reinhold Company, New York, 1970, p. 667. The moisture content at any given relative humidity depends on whether the paper approached equilibrium conditions from a more dry state or a more moist state; the latter situation typically results in higher moisture contents. Consequently, Table 2 reflects approximate values for paper when equilibrium was approached from a more moist state.

The paper base was a creped paper having a basis weight of 11.7 lbs/1300 $ft^2$ (44 $g/m^2$) before impregnation. The paper was composed of northern bleached kraft softwood (76 percent by weight) and western bleached red cedar (24 percent by weight). The stretch level was 14 percent. The tensile ratio (MD/CD) and average breaking length were 0.9 and 2.5 km, respectively.

The latex as supplied typically consisted of about 40–50 percent by weight solids. Bulking agent was added to the latex component to give a predetermined percent by weight, based on the dry weight of polymer in the latex, except for Formulation A which was used as a control. Additional water was added to each formulation in order to adjust the solids content to about 25–40 percent by weight. 15 The latex formulations employed are summarized in Tables 3 and 4.

TABLE 3

Summary of Latex Formulations A–F

| | Parts by Dry Weight in Impregnant | | | | | |
|---|---|---|---|---|---|---|
| Component | A | B | C | D | E | F |
| DL-219 | 100 | 100 | 100 | 100 | 100 | 100 |
| Trisodium phosphate | 2 | 2 | 2 | 2 | 2 | 2 |
| Triethylene glycol | — | 35 | 25 | 15 | — | — |
| Glycerin | — | — | — | — | 35 | 15 |

TABLE 4

Summary of Latex Formulations G–M

| | Parts by Dry Weight in Impregnant | | | | | | |
|---|---|---|---|---|---|---|---|
| Component | G | H | I | J | K | L | M |
| DL-219 | 100 | 100 | 100 | 100 | 100 | 100 | 100 |
| Trisodium phosphate | 2 | 2 | 2 | 2 | 2 | 2 | 2 |
| Diethylene glycol | 35 | 15 | — | — | — | — | — |
| Carbowax ® 1000 | — | — | 25 | — | — | — | — |
| Carbowax ® 200 | — | — | — | 25 | — | — | — |
| Triethylene glycol | — | — | — | — | 40 | 50 | 60 |

The paper was impregnated with a latex at a pickup level, on a dry weight basis, of 50±3 percent, based on the dry weight of the paper before impregnation. Each sheet was placed in an impregnating medium, removed, and allowed to drain. The sheet then was placed on a steam-heated drying cylinder for 30 seconds to remove most of the moisture. Sheets were equilibrated in desiccators under controlled relative humidities of 10, 20, 50, 80,and 100 percent. Control of relative humidity was accomplished through the use of various inorganic salt solutions having known vapor pressures which were placed in the bottoms of the desiccators. To remove all of the moisture from a sheet, the sheet was placed in an oven at 105° C. for five minutes. The dried sheets were placed in plastic bags until they could be tested in order to minimize absorption of water from the atmosphere.

The cross-direction tear of the sheets then was determined, as already noted, with an Elmendorf Tear Tester. Four sheets were torn at a time, and the test was conducted six times for every latex formulation used (i.e., six replicates per formulation). Sample sheet dimensions were 2.5×3 inches (6.4×7.6 cm). The shorter dimension was parallel to the direction being tested. The results for each latex formulation then were averaged and reported as grams per 4 sheets. The cross-direction tear results are summarized in Tables 5 and 6;for convenience, a relative humidity (RH) of 0 percent is used to indicate essentially zero moisture content.

TABLE 5

Cross Direction Tear Results - Formulations A–F

| Percent | Cross-Direction Tear (Grams/4 Sheets) | | | | | |
|---|---|---|---|---|---|---|
| RH | A | B | C | D | E | F |
| 100 | 39.5 | 45.0 | 44.8 | 44.5 | — | — |
| 80 | 31.5 | 37.5 | 36.2 | 36.5 | — | — |
| 50 | 18.2 | 20.0 | 20.0 | 18.2 | — | — |
| 20 | 13.5 | 15.0 | 14.8 | 13.5 | — | — |
| 10 | 9.8 | 13.0 | 11.2 | 10.8 | — | — |
| 0 | 8.0 | 12.0 | 10.2 | 9.5 | 10.0 | 8.8 |

TABLE 6

Cross Direction Tear Results - Formulations G–M

| Percent | Cross-Direction Tear (Grams/4 Sheets) | | | | | | |
|---|---|---|---|---|---|---|---|
| RH | G | H | I | J | K | L | M |
| 100 | — | — | 36.2 | 35.0 | — | — | — |
| 80 | — | — | 31.0 | 31.2 | — | — | — |
| 50 | — | — | 18.2 | 18.8 | — | — | — |
| 20 | — | — | 12.2 | 14.0 | — | — | — |
| 10 | — | — | 11.2 | 11.2 | — | — | — |
| 0 | 12.0 | 11.5 | 8.8 | 9.8 | ≈12.0 | ≈13.8 | ≈14.2 |

The data in Tables 5 and 6 clearly demonstrate the ability of a bulking agent to increase the cross-direction tear of a latex-impregnated paper. To aid in understanding the results presented in the Tables 5 and 6,the percent difference (PD) at each relative humidity tested for each formulation, relative to the control (Formulation A), was calculated as follows:

$$PD=100\times(CD\text{ Tear}-\text{Control }CD\text{ Tear})/\text{Control }CD\text{ Tear}$$

in which "CD Tear" represents, at the same relative humidity, the cross-direction tear value for a formulation which contains bulking agent and "Control CD Tear" represents the cross-direction tear value for Formulation A. The percent difference calculations are summarized in Tables 7 and 8.

TABLE 7

Percent Difference Calculations - Formulations A–F

| Percent | Percent Difference | | | | | |
|---|---|---|---|---|---|---|
| RH | A | B | C | D | E | F |
| 100 | — | 14 | 13 | 13 | — | — |
| 80 | — | 19 | 15 | 16 | — | — |
| 50 | — | 10 | 10 | 0 | — | — |
| 20 | — | 11 | 9 | 0 | — | — |
| 10 | — | 33 | 15 | 10 | — | — |
| 0 | — | 50 | 28 | 19 | 25 | 9 |

TABLE 8

Percent Difference Calculations - Formulations G–M

| Percent | Percent Difference | | | | | | |
|---|---|---|---|---|---|---|---|
| RH | G | H | I | J | K | L | M |
| 100 | — | — | −8 | −11 | — | — | — |
| 80 | — | — | −2 | −1 | — | — | — |
| 50 | — | — | 0 | 3 | — | — | — |
| 20 | — | — | −9 | 4 | — | — | — |
| 10 | — | — | 15 | 15 | — | — | — |
| 0 | 50 | 44 | 9 | 22 | ≈50 | ≈72 | ≈78 |

In addition, the data in Tables 7 and 8 for Formulations B-M, inclusive, were plotted as three-dimensional bar graphs, with four formulations per graph for convenience. The graphs consist of clusters of the percent differences, represented by bar heights, at the relative humidities tested. These graphs are shown in FIGS. 1–3, inclusive.

Figure 2:
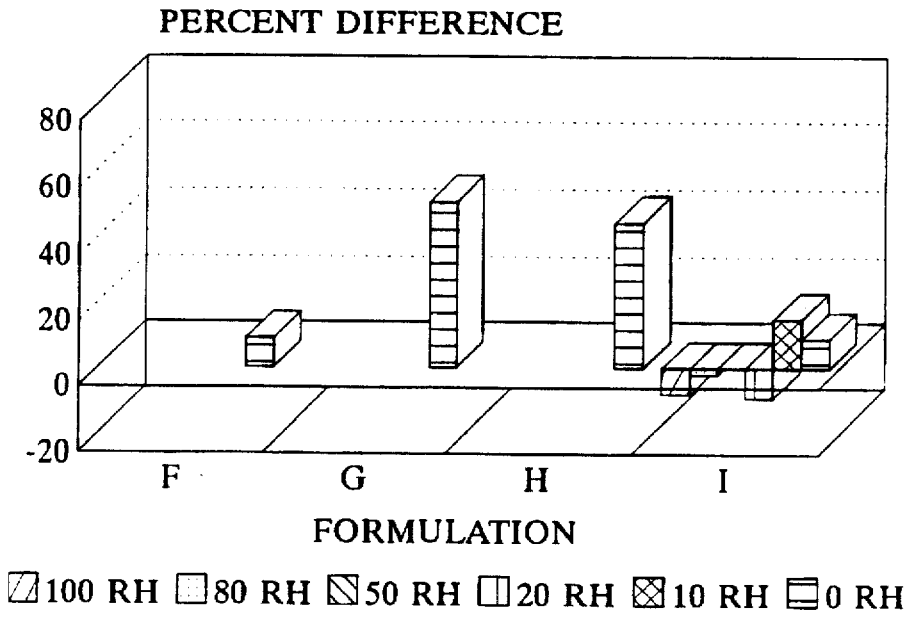
Figure 3:
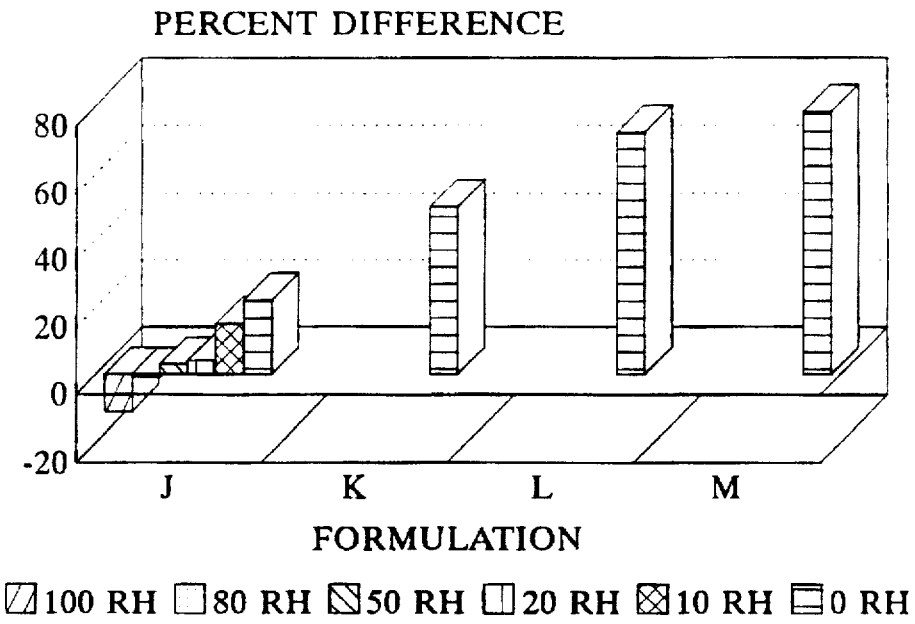

From the percent difference calculations presented in Tables 7 and 8 and FIGS. 1–3, it is evident that the extent of improvement in cross-direction tear is directly proportional to the amount of bulking agent employed. However, levels of bulking agent above 35 percent by weight gave less reproducible results. When the bulking agents are structurally similar, as in a homologous series, e.g., diethylene glycol, triethylene glycol, Carbowax® 200,and Carbowax® 1000,the extent of improvement appears to be inversely proportional to the molecular weight of the bulking agent. Furthermore, some formulations were effective at all relative humidities tested, while others appear to be effective only at low, i.e., less than 20 percent, relative humidities. Finally, it may be noted that other physical properties, such as caliper, machine-direction dry tenacity, machine-direction dry stretch, and delamination were not significantly adversely effected by the presence of bulking agent in the latex-impregnating medium.

EXAMPLE 2

Because a major use of a latex-impregnated creped paper is as a base for a high-temperature applications masking tape, the effect of prolonged heating on the cross-direction tear was of interest. Accordingly, papers prepared in Example 1 with Formulations A (a control with no bulking agent), B (35 percent by weight triethylene glycol as bulking agent), and C (35 percent by weight diethylene glycol as bulking agent) were heated in an oven at 105° C. for 45 minutes. Samples of papers were removed after 5 minutes, 10 minutes, 15 minutes, and 45 minutes and tested for cross-direction tear. The results are given in Table 9.

TABLE 9

Effect of Prolonged Heating on Cross-Direction Tear

| Formulation | Cross-Direction Tear After Heating (105° C.) 5 Min. | 10 Min. | 15 Min. | 45 Min. |
|---|---|---|---|---|
| A | 8.0 | 8.0 | 8.0 | 7.8 |
| B | 12.0 | 11.5 | 11.2 | 10.8 |
| G | 12.0 | 11.5 | 11.0 | 10.2 |

The data in Table 9 suggest that higher molecular weight or less volatile bulking agents are desirable when the paper is utilized as a base for high temperature masking tapes.

EXAMPLE 3

In addition to the results of Example 2 which demonstrated a decrease in cross-direction tear through prolonged heating, trims with a DL-219 latex-impregnating medium containing 33 percent by weight, based on the dry weight of latex, of triethylene glycol as the bulking agent resulted in the generation of large amounts of glycol smoke. Thus, it was evident that bulking agent volatility also was a concern during the manufacture of the base paper.

In order to qualitatively evaluate the volatilities of various polyethylene glycols, samples of polyethylene glycols having varying molecular weights were heated at about 102° C. in open weighing dishes. Polyethylene glycols having molecular weights of about 300 and higher did not show a detectable weight change after one week.

Accordingly, the procedure of Example 1 was repeated. The latex formulations employed are summarized in Table 10 and the cross-direction tear results are summarized in Table 11. The solids contents of Formulations N, O, and P were 28 percent, 49 percent, and 53 percent, respectively, and the pick-up levels, on a dry weight basis, were 40, 50 and 60 percent by weight, respectively.

TABLE 10

Summary of Latex Formulations N–P

| Component | Parts by Dry Weight in Impregnant N | O | P |
|---|---|---|---|
| DL-219 | 100 | 100 | 100 |
| Ammonia | 0.5 | 0.5 | 0.5 |
| Scripset 540* | 1 | 1 | 1 |
| Carbowax ® 300 | — | 25 | 50 |

*A mixture of methyl and isobutyl partial esters of styrene/maleic anhydride copolymer which improves paper machine runability.

TABLE 11

Cross Direction Tear Results - Formulations N–P

| Percent RH | Cross-Direction Tear* N | O | P |
|---|---|---|---|
| 50 | 14.8 | 15.0 | 16.8 |
| 0 | 7.8 | 9.5 | 11.5 |

*Grams/4 sheets.

Figure 4:
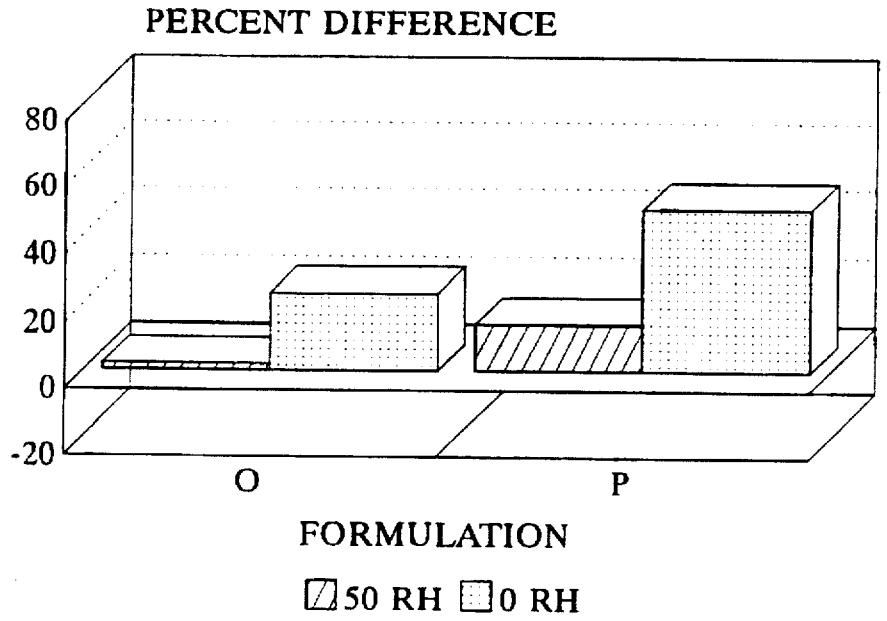

As in Example 1,percent differences for the results with Formulations O and P relative to Formulation N were calculated and are give in Table 12. In addition, the calculations presented in Table 12 were plotted as three-dimensional bar graphs, as already described. Such plot is shown in FIG. 4.

TABLE 12

Percent Difference Calculations - Formulations N–P

| Percent RH | Percent Difference N | O | P |
|---|---|---|---|
| 50 | — | 2 | 14 |
| 0 | — | 23 | 48 |

At the lower level of incorporation in the latex formulation, triethylene glycol has a significantly greater effect on cross-direction tear under dry conditions (zero percent relative humidity). The higher level of triethylene glycol significantly improved cross-direction tear under both conditions of relative humidity, although the effect was greater under dry conditions (a 48 percent increase over the control, Formulation N, as compared with 14 percent increase over the control).

EXAMPLE 4

Figure 5:
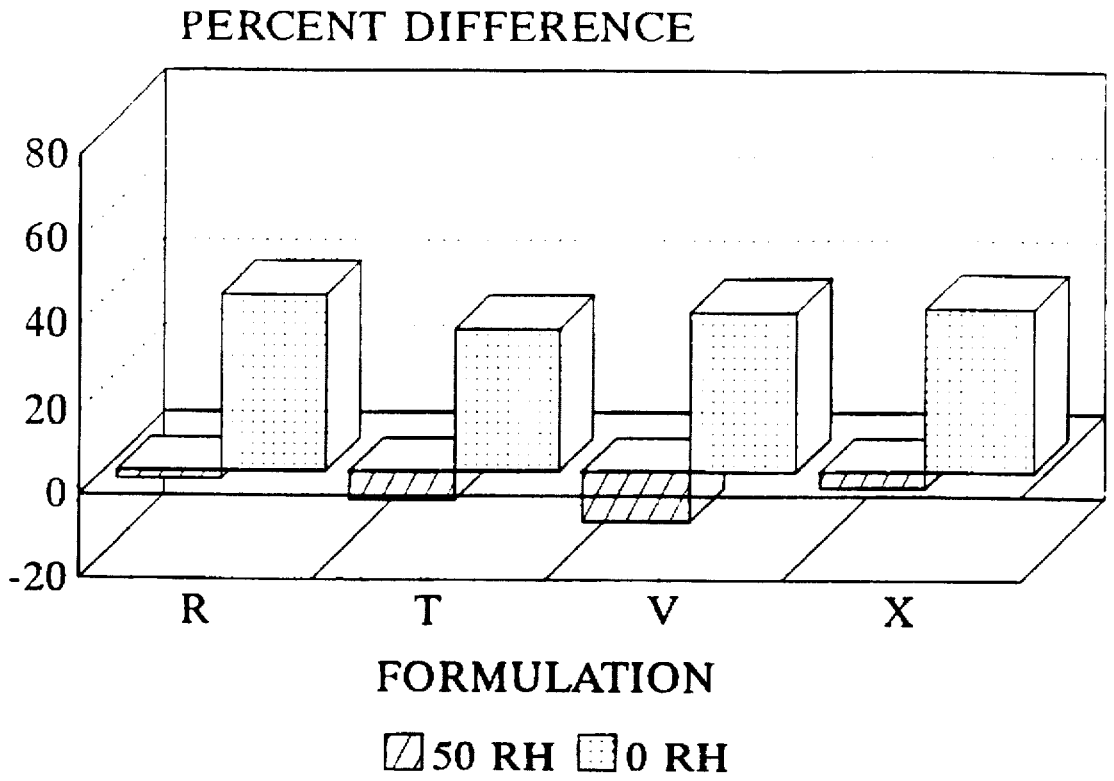

The procedure of Example 1 was repeated with four additional latex formulations. Those formulations which did not include the bulking agent consisted of about 25 percent by weight solids and the formulation pick-up was set at 40 percent by dry weight, based on the dry weight of the paper. The formulations which included bulking agent consisted of about 40 percent by weight solids and the formulation pick-up was set at 60 percent by dry weight, based on the dry weight of the paper. The latex formulations are summarized in Table 13 and the cross-direction tear results are summarized in Table 14. In addition, percent differences were calculated and plotted as a three-dimensional bar graph as described earlier. The calculations are summarized in Table 15 and the graph is shown in FIG. 5.

TABLE 13

Summary of Latex Formulations Q–X

| Component | Parts by Dry Weight in Impregnant O | R | S | T | U | V | W | X |
|---|---|---|---|---|---|---|---|---|
| Hycar 26083 | 100 | 100 | — | — | — | — | — | — |
| Butofan 4262 | — | — | 100 | 100 | — | — | — | — |
| Hycar 1562X28 | — | — | — | — | 100 | 100 | — | — |
| Xlink 2833 | — | — | — | — | — | — | 100 | 100 |
| Ammonia | 0.5 | 0.5 | 0.5 | 0.5 | 0.5 | 0.5 | 0.5 | 0.5 |
| Carbowax ® 300 | — | 50 | — | 50 | — | 50 | — | 50 |

TABLE 14

Cross Direction Tear Results - Formulations Q–X

| Percent RH | Cross-Direction Tear (Grams/4 Sheets) Q | R | S | T | U | V | W | X |
|---|---|---|---|---|---|---|---|---|
| 50 | 15.0 | 14.8 | 14.8 | 13.8 | 20.8 | 18.2 | 12.2 | 11.8 |
| 0 | 8.5 | 12.0 | 9.0 | 12.0 | 12.8 | 17.8 | 8.0 | 11.0 |

TABLE 15

Percent Difference Calculations - Formulations Q–X

| Percent | Percent Difference | | | | | | | |
|---|---|---|---|---|---|---|---|---|
| RH | Q | R | S | T | U | V | W | X |
| 50 | — | 0 | — | −7 | — | −14 | — | 0 |
| 0 | — | 50 | — | 33 | — | 38 | — | 38 |

Formulations Q, S, U, and W, of course, served as controls. When dry, the cross-direction tear was improved in every case. Interestingly, the cross-direction tear either did not change or decreased slightly at 50 percent relative humidity.

EXAMPLE 5

In all of the preceding examples, the bulking agent was included in the polymer-impregnating medium. As will be shown in this example, other means of incorporating the bulking agent in a polymer-reinforced paper can be employed.

Two different latex-impregnated creped papers were used, identified herein as Papers I and II. The Paper I base had a basis weight of 11.7 lbs/1300 $ft^2$ (44 $g/m^2$) before impregnation and was composed of 46 percent by weight of northern bleached softwood kraft and 54 percent by weight of western bleached cedar kraft. The impregnant was Hycar 26083 at a level of 40 percent by weight, based on the dry weight of fiber. The Paper II base had a basis weight of 10.5 lbs/1300 $ft^2$ (40 $g/m^2$) before impregnation and was composed of 79 percent by weight of northern bleached softwood kraft and 21 percent by weight of western bleached cedar kraft. The impregnant was a 50/50 weight percent mixture of Butofan 4262 and clay; the pick-up level was 25 percent by weight, based on the dry weight of fiber.

Samples of each paper were coated on one side with Carbowax® 300 by means of a blade. The bulking agent was applied at a level of 0.29 lbs/1300 $ft^2$ (1.1 $g/m^2$). The samples then were stacked, coated side to uncoated side, and pressed in a laboratory press; the applied pressure was about 25 $lbs/in^2$ (about 1.8 $kg/cm^2$).

After being pressed for 72 hours, the papers were tested for cross-direction tear at zero relative humidity. Papers similarly stacked and pressed but not coated with the bulking agent were used as controls. The cross-direction tear results and the percent difference calculations are summarized in Table 16.

TABLE 16

Cross Direction Tear Results and Percent Difference Calculations Papers I and II at Zero Relative Humidity

| | CD Tear[a] | | |
|---|---|---|---|
| Paper | Control | Coated | Percent Difference |
| I | 9.2 | 17.8 | 93 |
| II | 6.5 | 12.8 | 97 |

[a]Cross-direction tear, grams/4 sheets.

While Papers I and II were tested only at zero percent relative humidity, the increases in cross-direction tear are remarkable. Such increases are, in fact, the highest of all of the examples described herein.

EXAMPLE 6

In all of the preceding examples, a creped paper base was employed. This example described the results of experiments carded out with a flat, i.e., noncreped, paper base sheet having a basis weight of 13.2 lbs/1300 $ft^2$ (50 $g/m^2$) before impregnation. The paper was composed of northern bleached kraft softwood.

The procedure described in Example 4 was followed. The latex formulations are summarized in Table 17 and the cross-direction tear results and percent difference calculations are summarized in Table 18.

TABLE 17

Summary of Latex Formulations AA–DD

| | Parts by Dry Weight in Impregnant | | | |
|---|---|---|---|---|
| Component | AA | BB | CC | DD |
| Butofan 4262 | 100 | 100 | — | — |
| Hycar 26083 | — | — | 100 | 100 |
| Ammonia | 0.5 | 0.5 | — | — |
| Carbowax ® 300 | — | 50 | — | 50 |

TABLE 18

Cross Direction Tear Results - Formulations AA–DD (Zero Percent Relative Humidity)

| Formulation | CD Tear[a] | Percent Difference |
|---|---|---|
| AA | 10.5 | — |
| BB | 14.8 | 41 |
| CC | 12.2 | — |
| DD | 17.8 | 46 |

[a]Cross-direction tear, grams/4 sheets.

Formulations AA and CC served as controls. When dry (i.e., zero percent relative humidity, the only condition tested), the cross-direction tear was significantly improved in both cases.

Having thus described the invention, numerous changes and modifications thereof will be readily apparent to those having ordinary skill in the art without departing from the spirit or scope of the invention.

What is claimed is:

1. A method of forming a polymer-reinforced paper comprising:

preparing an aqueous suspension of fibers, at least about 50 percent of which on a dry weight basis are cellulosic fibers;

distributing the suspension on a forming wire; removing water from the distributed suspension to form a paper; and treating the paper with a latex reinforcing medium which comprises:

a latex reinforcing polymer in an amount sufficient to provide the paper with from about 10 to about 70 percent, by weight, of reinforcing polymer, based on the dry weight of the paper; and from about 15 to about 70 percent by weight, based on the dry weight of the cellulosic fibers, of a polyethylene glycol having a molecular weight of from about 100 to about 1,500;

wherein the amounts of latex reinforcing polymer and polyethylene glycol are adapted to provide, when the polymer-reinforced paper has a moisture content less than about 5 percent by weight, an average cross-direction tear as measured with an Elmendorf Tear Tester in accordance with TAPPI Method T414 which is from about 10 to about 100 percent higher than the cross-direction tear of an otherwise identical polymer-reinforced paper which lacks the polyethylene glycol.

2. The method of claim 1, in which the paper formed upon removal of water is dried prior to being treated with the latex reinforcing medium.

3. The method of claim 2, in which the paper formed upon removal of water is creped prior to being dried.

4. The method of claim 1, in which the polyethylene glycol has a molecular weight in a range of from about 200 to about 1,000.

5. The method of claim 3, in which the polymer-reinforced paper is adapted for use as a masking tape base.

6. The method of claim 1, in which the polymer-reinforced paper is adapted for use as an abrasive paper base.

7. The method of claim 1, in which the polymer-reinforced paper is adapted for use as a flexible, tear-resistant marking label base.

8. The method of claim 1, in which the amounts of latex reinforcing polymer and polyethylene glycol are adapted to provide, when the polymer-reinforced paper has a moisture content less than about 3 percent by weight, an average cross-direction tear as measured with an Elmendorf Tear Tester in accordance with TAPPI Method T414 which is in a range of from about 20 to about 100 percent higher than the cross-direction tear of an otherwise identical polymer-reinforced paper which lacks the polyethylene glycol.

9. The method of claim 8, in which the polyethylene glycol has a molecular weight of from about 100 to about 1,000.

10. A method of forming a polymer-reinforced creped paper comprising:

preparing an aqueous suspension of fibers, at least about 50 percent of which on a dry weight basis are cellulosic fibers;

distributing the suspension on a forming wire;

removing water from the distributed suspension to form a paper;

creping the paper thus formed;

drying the creped paper;

treating the creped paper with a latex reinforcing medium which comprises:

a latex reinforcing polymer in an amount sufficient to provide the paper with from about 10 to about 70 percent, by weight, of reinforcing polymer, based on the dry weight of the paper; and from about 15 to about 70 percent by weight, based on the dry weight of the cellulosic fibers, of a polyethylene glycol having a molecular weight of from about 100 to about 1,500; and drying the treated creped paper;

wherein the amounts of latex reinforcing polymer and polyethylene glycol are adapted to provide, when the paper has a moisture content less than about 5 percent by weight, an average cross-direction tear as measured with an Elmendorf Tear Tester in accordance with TAPPI Method T414 which is from about 10 to about 100 percent higher than the cross-direction tear of an otherwise identical polymer-reinforced paper which lacks the polyethylene glycol.

11. The method of claim 10, in which the polyethylene glycol has a molecular weight in the range of from about 200 to about 1,000.

12. The method of claim 10, in which the amounts of latex reinforcing polymer and polyethylene glycol are adapted to provide, when the paper has a moisture content less than about 3 percent by weight, an average cross-direction tear as measured with an Elmendorf Tear Tester in accordance with TAPPI Method T414 which is in a range of from about 20 to about 100 percent higher than the cross-direction tear of an otherwise identical polymer-reinforced paper which lacks the polyethylene glycol.

13. A method of forming a polymer-reinforced paper comprising:

preparing an aqueous suspension of fibers, at least about 50 percent of which on a dry weight basis are cellulosic fibers;

distributing the suspension on a forming wire;

removing water from the distributed suspension to form a paper;

treating the paper with a latex reinforcing polymer in an amount sufficient to provide the paper with from about 10 to about 70 percent, by weight, of reinforcing polymer, based on the dry weight of the paper; and coating the treated paper with a polyethylene glycol having a molecular weight in a range of from about 100 to about 1,500 so that the paper is provided with from about 15 to about 70 percent, by weight, of the polyethylene glycol, based on the dry weight of the cellulosic fibers in the paper;

wherein the amounts of latex reinforcing polymer and polyethylene glycol are adapted to provide, when the paper has a moisture content less than about 5 percent by weight, an average cross-direction tear as measured with an Elmendorf Tear Tester in accordance with TAPPI Method T414 which is from about 10 to about 100 percent higher than the cross-direction tear of an otherwise identical polymer-reinforced paper which lacks the polyethylene glycol.

14. The method of claim 13, in which the paper formed upon removal of water is dried prior to being treated with the latex reinforcing polymer.

15. The method of claim 14, in which the paper formed upon removal of water is creped prior to being dried.

16. The method of claim 13, in which the amounts of latex reinforcing polymer and polyethylene glycol are adapted to provide, when the paper has a moisture content less than about 3 percent by weight, an average cross-direction tear as measured with an Elmendorf Tear Tester in accordance with TAPPI Method T414 which is in a range of from about 20 to about 100 percent higher than the cross-direction tear of an otherwise identical polymer-reinforced paper which lacks the polyethylene glycol.

17. The method of claim 13, in which the polyethylene glycol has a molecular weight of from about 100 to about 1,000.

* * * * *